United States Patent [19]

Todd

[11] Patent Number: 4,804,970

[45] Date of Patent: Feb. 14, 1989

[54] EQUIPHASE REFRACTIVE ANTENNA LENS

[75] Inventor: John R. Todd, Palm Bay, Fla.

[73] Assignee: Harris Corp., Melbourne, Fla.

[21] Appl. No.: 730,997

[22] Filed: May 6, 1985

[51] Int. Cl.[4] ..... H01Q 15/08; H01Q 19/06

[52] U.S. Cl. ..... 343/753; 343/909; 343/911 R; 264/2.3; 264/334

[58] Field of Search ..... 343/753–755, 343/909, 910, 911 R; 350/452; 264/1.1, 1.7, 1.9, 2.3, 104, 318, 334, 336

[56] References Cited

U.S. PATENT DOCUMENTS

| | | | |
|---|---|---|---|
| 2,547,416 | 4/1951 | Skellett | 343/753 |
| 3,698,001 | 10/1972 | Koyama et al. | 343/909 |
| 3,886,561 | 5/1975 | Beyer | 343/911 R |
| 4,170,616 | 10/1979 | Jebens | 264/1.7 |
| 4,443,088 | 4/1984 | Ohtaka | 264/1.1 |
| 4,456,344 | 6/1984 | Bordignon | 350/286 |

FOREIGN PATENT DOCUMENTS

| | | | |
|---|---|---|---|
| 352159 | 2/1961 | Switzerland | 350/452 |

*Primary Examiner*—William L. Sikes
*Assistant Examiner*—Michael C. Wimer
*Attorney, Agent, or Firm*—Antonelli, Terry & Wands

[57] ABSTRACT

A dielectric antenna lens for planar wavefront/focal point conversion is configured of a series of concentric rings, each of which is contoured from a rear face to inclined termination edges that are delimited by the functional performance of the lens and which assist in the manufacture of the lens. In addition, the bottom edge of each ring, rather than terminate at a cylindrical side wall of an adjacent ring, terminates at a flattened region between itself and the adjacent ring. This flattened region effectively eliminates the acute angle wedge between rings and, together with the inclined termination edges of the rings, serves to enable the lens to be easily manufactured, as by injection molding, with the flattened land portions and inclined termination edges making possible removal of the lens from the injection mold.

As a further aspect of the present invention there is provided a multiple wavelength conversion arrangement employing the dielectric lens in combination with a wavelength selective (e.g. dichroic) filter, enabling the lens to be used as part of a compact microwave transceiver unit operating at a plurality of different frequencies.

10 Claims, 4 Drawing Sheets

EQUIPHASE REFRACTIVE ANTENNA LENS

FIELD OF THE INVENTION

The present invention relates in general to antenna systems and is particularly directed to a refractive antenna lens structure for focussing a planar or flat wavefront to a prescribed focal point.

BACKGROUND OF THE INVENTION

The continuing growth and refinement of microwave communication systems, particularly satellite communication systems, have required the development of signal transmission and focussing structures that ensure precisely controlled directivity patterns between stations. As applications of satellite communication systems continue to diversify, size and cost reductions of system components become significant design criteria. In addition to the use of modulation techniques that enable an earth station to employ an antenna structure of reduced diameter, improvements have been made in the configuration, size and materials of the focussing elements that lend themselves to ease of fabrication, installation and improved performance.

For narrow beam, highly directive links such as exist in many present day satellite communication networks, refractive type structures have been found to be preferred to the more costly parabolic reflector geometry structures. One example of a refractive microwave structure that serves to focus a narrow beam planar wavefront to a prescribed focal point is described in the U.S. Pat. No. 2,547,416 to Skellett. As shown in FIG. 1, which is a less cluttered version of FIG. 1 of the Skellett patent, a dielectric antenna lens 1 is effectively configured of a series of adjacent dielectric rings 3 each having a surface contour of varying thickness. These rings operate to produce a series of phase delays, such that, at a prescribed frequency, a wave emanating from the lens focal point will be diffracted through the rings 3 of the lens 1 to produce an emergent wavefront that is concentrated in an equiphase plane (e.g. planes $P_1$, $P_2$, $P_3$). According to the description in the patent, the surface contour of each ring is defined mathematically in accordance with the location of the focal point of the lens and the plane of the equiphase front to be produced, each ring extending from the cylindrical side wall of an adjacent ring (e.g. side walls 4, 5) to its own cylindrical side wall, each cylinder wall extending from a calculated equiphase contour line and terminating at some thickness m from the flat face 2 of the lens. The cylindrical edges of each ring or "contour zone" (except for the central zone) are then partially tapered and the outer edges of the rings are rounded off to reduce what the patentee refers to as adverse effects of refraction and diffraction.

Now although, mathematically, the Skellett dielectric lens is designed to refractively produce a planar wavefront from a prescribed focal point, the actual configuration proposed by the patentee cannot be practically manufactured and, therefore, has not enjoyed use in microwave communication systems.

More particularly, in the Skellett dielectric antenna the contoured surface of each successive ring forms an ever decreasing acute angle with the cylindrical side wall of the next ring. Even with the slight tapering proposed by the patentee the narrow crevice between rings resulting from this acute angle creates a complex manufacturing problem, effectively requiring that each ring be individually machined from a given thickness of dielectric material, thereby making the cost of manufacture prohibitively expensive. In addition, using the cylindrical boundary approach not only makes the antenna complex and costly to produce, but it adds extra dielectric material that does not participate in the focussing action of the lens and increases the weight of the lens.

SUMMARY OF THE INVENTION

In accordance with the present invention, there is provided an improved dielectric antenna lens for planar wavefront/focal point conversion and a method of manufacturing the same that offers the equiphase wavefront generation functionally intended by the Skellett design, but in a configuration that is practically manufacturable and more accurately contoured from a performance and size standpoint. To this end the dielectric antenna configuration of the present invention is configured of a series of concentric rings, each of which is contoured from a rear face to inclined termination edges that are delimited by the functional performance of the lens and which assist in the manufacture of the lens. In addition, the bottom edge of each ring, rather than terminate at a cylindrical side wall of an adjacent ring, as in the Skellett approach, terminates at a flattened region between itself and the adjacent ring. This flattened region effectively eliminates the acute angle crevice between rings of the Skellett configuration and, together with the inclined termination edges of the rings, serves to enable the lens to be easily manufactured, as by injection molding, with the flattened land portions and inclined termination edges making possible removal of the lens from the injection mold, something that the acute angle crevices and cylindrical side walls of the Skellett configuration cannot offer.

As a further aspect of the present invention there is provided a multiple wavelength conversion arrangement employing the dielectric lens in combination with a wavelength selective (e.g. dichroic) filter, enabling the lens to be used as part of a compact microwave transceiver unit operating at a plurality of different frequencies. To function as a common antenna for both a transmitter and a receiver operating at different frequencies, the frequency at which the antenna is configured to produce a planar wave front from a prescribed focal point is selected to lie between the transmit/-receive frequencies. Each of these latter frequencies is close enough for the prescribed frequency for which the rings of the dielectric lens antenna are contoured to provide substantial performance of the system. By use of a dichroic filter, spatial separation of the two frequencies is achieved, thereby providing a simplified scheme for narrow beam focussing of separate transmit and receive frequencies.

DETAILED DESCRIPTION

Figure 1:
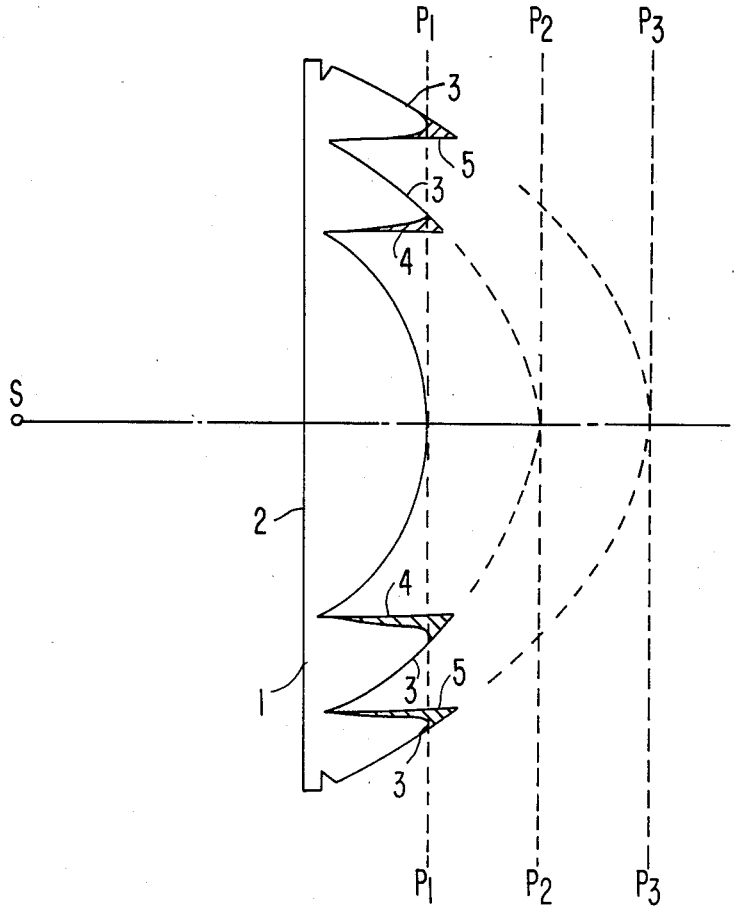
FIG. 1. PRIOR ART
FIG. 1 is a diagrammatic illustration of a multi-ring dielectric lens of the type described in the U.S. Pat. No. 2,547,416 to Skellett.
Figure 2:
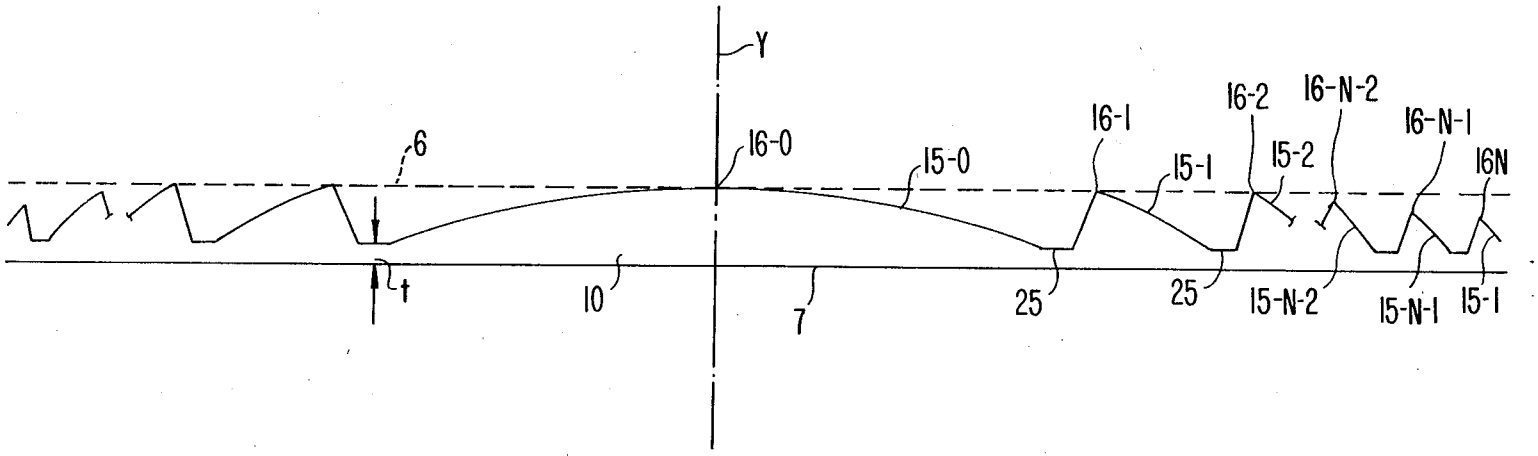
FIG. 2 is a diagrammatic illustration of a multi-ring dielectric lens according to the present invention.

Referring now to FIG. 2, there is shown a diagrammatic illustration of improved dielectric antenna lens structure of the present invention. As in the lens configuration disclosed in the patent to Skellett, shown in FIG. 1, referenced above, the dielectric lens of the present invention comprises a central portion the surface 15-0 of which is symmetrically contoured about an axis Y, and a series of rings whose respectively contoured surfaces 15-1, 15-2 . . . **15-*n*, are concentrically arranged about an axis Y and are successively adjacent to one another. The contour of each ring surface 15-*i* is such that rays emanating from some focal point 8 lying along axis Y and impinging upon a face 7 of the lens 10 are concentrated into equiphase planes, such as equiphase plane 6, which is parallel to the face 7 of the lens 10. As shown in FIG. 2, face 7 of lens 10 preferrably has a planar or flat surface the entirety of which is normal to axis Y. However, it need not be flat, but may be slightly concave to reduce structural loading due to high wind loads. In the concave configuration that portion of the surface of face 7** through which axis Y passes is substantially flat.

Contrasted with the configuration of the prior art shown in FIG. 1, however, is the fact that the interior faces of each ring, namely those faces which are nearest axis Y, are not substantially normal to face 7 or cylindrically shaped, as in the lens o the prior art, but are rather substantially inclined, so as to eliminate unnecessary material of the lens and thereby save weight and to permit practical manufacture of the lens. In addition, between each successive ring **15-*i* substantially flat land portions 25, having a thickness t with respect to the face 7 of the lens, are provided. The practical effect of these inclined faces and the land portions, as well as the precise definition of the inclined faces and the contoured surface of each ring will be described below with reference to FIG. 3**.

Figure 3:
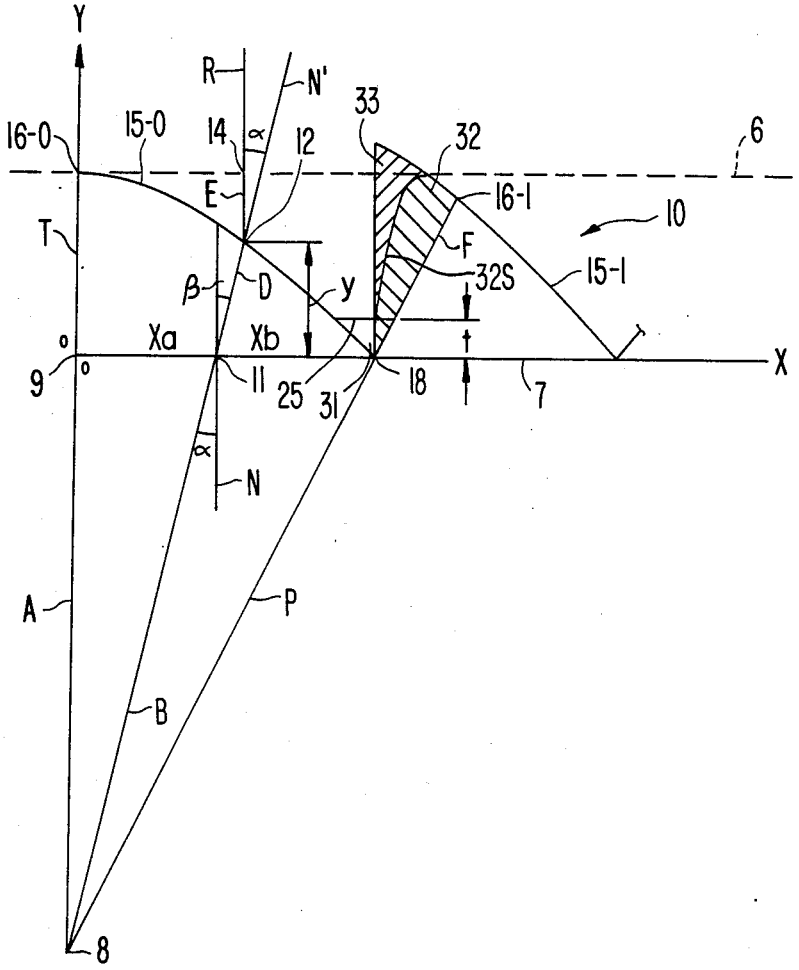
FIG. 3 is a diagrammatic illustration of a portion of the multi-ring dielectric lens shown in FIG. 2.

FIG. 3 shows, in greater detail, a diagrammatic view of a portion of the central contoured surface 15-0 and the first ring 15-1 of the lens shown in FIG. 2. Also diagrammatically illustrated in FIG. 3 are a series of geometrical lines to be referenced below in explaining the manner in which the surface of each ring is defined. In FIG. 3, the axis Y of the lens is shown as extending from the focal point 8 in a vertical direction normal to the face 7 of the lens. The surface of face 7 lies in a plane X which is normal to axis Y, so that, in terms of the illustration of FIG. 3, the X and Y axes correspond to respective axes of a rectangular coordinate system. The distance between the focal point 8 and the face 7 of lens 10 is denoted by line A which extends between focal point 8 and point 9 on axis Y which is coincident with the face 7 of lens 10. The maximum thickness of the lens along axis Y is denoted by line T, which extends between point 9 and a point 16-0 at the vertex of the central lobe or contoured surface 15-0 of the lens.

Also shown in FIG. 3 is a line B which represents an arbitrary ray extending from the focal point 8 to some point 11 on the face 7 of the lens 10. A ray emanating from point 8 and travelling along line B is incident at some angle $\alpha$ relative to the normal N at point 11 and is refracted through the dielectric material of the lens (the dielectric constant of the material being denoted by Ed) at some angle $\beta$ relative to the normal N, so as to travel along line D from point 11 to an exit point 12 on the surface 15-0 of the central lobe of the lens. The ray then travels along a line R at an angle of refraction $\alpha$ relative to a normal N' to the surface 15-0. Ray R intersects a plane 6 which is parallel to the face 7 and intersects axis Y at point 16-0. Plane 6 represents an equiphase for all rays emanating from focal point 8 and refracted through the lens. The distance between the exit point 12 on surface 15-0 and the intersection of ray R at plane 6 is denoted by line E.

Also shown on the central lobe of the lens are line xa, which represents the distance between point 9 and point 11 on face 7, and a line xb, which represents the distance, in the X direction, between the point 11 whereat line B intersects the face 7 of the central lobe of the lens and the point 12 whereat ray R exits contour surface 15-0 of the central lobe of the lens. The distance along the Y direction between point 11 and point 12 is denoted by y.

Further illustrated in FIG. 3 is an initial ring adjacent the main lobe of the lens having a contoured surface 15-1 and an inclined face F, extending from face 7 of the lens to a peak 16-1 of surface 15-1. Connecting face F and the contoured surface 15-0 of the central lobe of the lens is a flat land portion 25, referenced briefly above in conjunction with the description of FIG. 2. As previously described, flat land portion 25 is separated from the face 7 of the lens by some thickness t.

Additionally shown in FIG. 3, and superimposed in shaded form, are a pair of adjacent areas 32 and 33 which makeup additional material of the prior art lens of FIG. 1, in the course of its initial manufacturing steps. Shaded area 33 corresponds to the area that is removed by an abrading or other process as described in the patent to Skellett referenced above. Even with removal of material 33, the side face 32S of region 32 still intersects contoured surface 15-0 of the central lobe of the lens at an acute angle-forming crevice 31, discussed briefly above. The differences between the present invention and the Skellett configuration and the advantages afforded by the present invention relative to that configuration will be discussed below after a brief description of the equiphase plane formation geometry in accordance with which the central lobe and the successive rings of the lens are configured.

For any ray emanating from focal point 8, at some wavelength $\lambda$, it is desired that the ray lie in a common or equiphase plane with all other rays emanating from the focal point. In effect, the central lobe and the successive rings of the lens are contoured to provide an equiphase plane or successive equiphase planes separated by integral multiples of 360° or $2\pi$. Ignoring, for the moment, the integral multiples of the equiphase plane, consider a single equiphase plane 6 shown in FIG. 3. In order to provide equiphase geometry, it is necessary to determine the x and y coordinates of the surfaces **15-*i* for the central lobe and each of the rings. This may be best illustrated by considering an arbitrary ray line B extending from focal point 8 and incident on rear face 7 of lens 10 at an angle of incidence $\alpha$ at point 11, which lies some distance xa from the axis Y at point 9 along the face 7 of the lens 10. As discussed briefly above, since the ray eventually emanates from point 12 on surface 15-0, the coordinates of the lens surface 15-0** in terms of the X and Y coordinate system employed are determined by sum of the distances $$xa+xb=x \quad (1)$$

and the height y.

Between focal point 8 and incident point 11, line B travels through air, which has a dielectric constant $E_{air}$ effectively equal to 1. Within the dielectric material of the lens, however, the ray is refracted at an angle $\beta$ along line D because of the refractive index Ed of the dielectric material of the lens. The relationship between the angle of incidence $\alpha$ and the angle of refraction $\beta$ may be therefore defined as:

$$(E_{air})^{\frac{1}{2}} \sin \alpha=(Ed)^{\frac{1}{2}} \sin \beta \quad (2)$$

Since the dielectric constant of air is equal to 1.0, equation (2) reduces to $$\sin \alpha=(Ed)^{\frac{1}{2}} \sin \beta \quad (2').$$

The distance xa between points 9 and 11 may be defined as $$xa=A \tan \alpha \quad (3),$$

while the distance xb between point 11 and point 12 along axis X may be defined by $$xb=Y \tan \beta \quad (4)$$

As mentioned above, for all rays which pass through equiphase plane 6, it is desired that that phase of the wavelengths emanating from focal point 8 be the same. Illustrating two cases, consider one ray travelling along axis Y (lines A-T) and another ray travelling along line B-D-E. Namely, at equiphase plane 6

$$\phi_{AT}=\phi \mathrm{BDE} \quad (5)$$

Along the Y axis, the following expression may be defined:

$$\phi_{8\text{-}9\text{-}16\text{-}0}=\phi_{A\text{-}T}=2\pi/\lambda A+2\pi/\lambda(Ed)^{\frac{1}{2}}\, T \quad (6)$$

Along line B-D-E-R, the phase may be defined as:

$$\phi_{8\text{-}11\text{-}12\text{-}14}=\phi_{B\text{-}D\text{-}E}=2\pi/\lambda B+2\pi/\lambda(Ed)^{\frac{1}{2}} D+2\pi/\lambda E \quad (7)$$

Equating equations (6) and (7) we obtain $$2\pi/\lambda A+2\pi/\lambda(Ed)^{\frac{1}{2}}\, T=2\pi/\lambda B=2\pi/\lambda(Ed)^{\frac{1}{2}} D+2\pi/\lambda E. \quad (8)$$

Dividing by the common term $2\pi/\lambda$ we obtain $$A+(Ed)^{\frac{1}{2}}\, T=B+(Ed)^{\frac{1}{2}}\, D+E \quad (9)$$

From the geometry shown in FIG. 2, line E is defined as:

$$E=T-y \quad (10)$$

Substituting equation (10) into equation (9) we obtain $$A+(Ed)^{\frac{1}{2}}\, T=B+(Ed)^{\frac{1}{2}}\, D+T-Y \quad (11)$$

In the above expression, A is a constant, T is a constant and B and D may defined by trigonometric relationships relative to constants or terms to be obtained. Namely, for $$B=\frac{xa}{\sin\alpha}=\frac{A}{\cos\alpha} \quad (12)$$

$$D=\frac{Y}{\sin\beta}=\frac{xb}{\cos\beta} \quad (13)$$

equation (11) may be redefined as:

$$A+(Ed)^{\frac{1}{2}}\, T=\frac{A}{\cos\alpha}+\frac{(Ed)^{\frac{1}{2}}\, y}{\sin\beta}+T-\mathrm{y} \quad (14)$$

Using this expression, the thickness y may be defined in terms of xa.

Rearranging equation (14) we obtain $$A+(Ed)^{\frac{1}{2}}\, T-\frac{A}{\cos\alpha}-T=\mathrm{y}\left(\frac{(Ed)^{\frac{1}{2}}}{\sin\beta}-1\right) \quad (15)$$

Equation (15) may be factored to obtain $$A\left\{1-\frac{1}{\cos\alpha}\right\}+T\{(Ed)^{\frac{1}{2}}-1\}=y\left\{\frac{(Ed)^{\frac{1}{2}}}{\sin\beta}-1\right\} \quad (16)$$

Replacing terms with standard trigonometric identities equation (16) becomes $$A\left\{1-\frac{1}{(1-\sin^2\alpha)^{\frac{1}{2}}}\right\}+T\{(Ed)^{\frac{1}{2}}-1\}=y\left\{\frac{(Ed)^{\frac{1}{2}}}{\sin\alpha/(Ed)^{\frac{1}{2}}}-1\right\} \quad (17)$$

or $$A\left\{1-\frac{1}{(1-\sin^2\alpha)^{\frac{1}{2}}}\right\}+T\{(Ed)^{\frac{1}{2}}-1\}=y\left\{\frac{Ed}{\sin\alpha}-1\right\} \quad (18)$$

Substituting rectangular coordinate expressions for the trigonometric angles of equation (18) as:

$$\sin\alpha=\frac{xa}{(xa^2+A^2)^{\frac{1}{2}}} \quad (19)$$

equation (18) becomes $$A\left\{1-\frac{1}{(1-xa^2/(xa^2+A^2))^{\frac{1}{2}}}\right\}+T\{(Ed)^{\frac{1}{2}}-1\}=y\left\{\frac{Ed}{xa/(xa^2+A^2)^{\frac{1}{2}}}-1\right\}. \quad (20)$$

Equation (20) gives the thickness y of the lens in terms of xa. Since it is desired to find y in terms of x, it is necessary to find y in terms of xb. Rewriting equation (16) below we obtain $$A\left\{1-\frac{1}{\cos\alpha}\right\}+T\{(Ed)^{\frac{1}{2}}-1\}=y\left\{\frac{(Ed)^{\frac{1}{2}}}{\sin\beta}-1\right\} \quad (16)$$

Substituting trigonometric identities for the expressions in equation (16) we obtain $$A\left\{1-\frac{1}{(1-\sin^2\alpha)^{\frac{1}{2}}}\right\}+T\{(Ed)^{\frac{1}{2}}-1\}=y\left\{\frac{(Ed)^{\frac{1}{2}}}{\sin\beta}-1\right\} \quad (21)$$

Making substitutions from equations (2) and (2') we obtain $$A\left\{1-\frac{1}{(1-Ed\sin^2\beta)^{\frac{1}{2}}}\right\}+T\{(Ed)^{\frac{1}{2}}-1\}= y\left\{\frac{(Ed)^{\frac{1}{2}}}{\sin\beta}-1\right\} \quad (22)$$

Using the trigonometric angular identity in terms of rectangular coordinates as:

$$\mathrm{Sin}\beta=\frac{xb}{(y^2+xb^2)^{\frac{1}{2}}} \quad (23)$$

equation (22) becomes $$A\left\{1-\frac{1}{(1-Edxb^2/(y^2+xb^2))^{\frac{1}{2}}}\right\}+T\{(Ed^{\frac{1}{2}})-1\}= y\left\{\frac{(Ed)^{\frac{1}{2}}}{xb/(y^2+xb^2)^{\frac{1}{2}}}-1\right\}. \quad (24)$$

Rewriting equation (24) we obtain $$A\{1-1/(1-Edbx^2/(y^2+xb^2))^{\frac{1}{2}}\}+T\{Ed^{\frac{1}{2}}-1\}=y\{(Ed^{\frac{1}{2}}/xb/(y^2+xb^2))^{\frac{1}{2}}-1\} \quad (25)$$

which gives y in terms of xb.

Given the two equations (20) and (25) for y in terms of xa and xb one may solve for xa and xb and thereby obtain the components of x. Then, y may then be computed in terms of x to define the contour surface **15-*i*** for each ring of the lens.

In accordance with the present invention, the entire contour of a particular surface **15-*i* is determined mathematically to the point where it intersects the face 7. The extremity of the surface 15-0 is shown in FIG. 3 by line P which intersects the face 7 at a vertex 18. From point 18 to peak 16-1 on the initial ring having contoured surface 15-1, there extends a face F. Face F delimits the extent to which a ray travels in the dielectric material of the lens. Namely, any ray traveling from the focal point 8 to the face 7 of the lens 10 to the right of line P will travel through the first ring and intersect the contoured surface 15-1 thereof and then be refracted in a direction normal to face 7 and equiphase line 6. No ray will be refracted from face F. Any ray to the left of line P will travel in the central lobe of the lens and be refracted from contoured surface 15-0** of the central lobe.

By the superposition of the lens configuration of the prior art shown in FIG. 1 on the lens configuration of the present invention shown in FIG. 3, it can be seen that, in the prior art, there is additional unnecessary material 32 which is retained. Material 32 serves no useful function in the operation of the lens, since rays emanating from the focal point 8 do not travel through material 32 on their way to the contoured surface 15-1. This means that this additional material 32, even taking into account the slight removal of material proposed in the prior art, as shown in shaded area 33, adds considerable weight to the lens. Moreover, and of particular significance, is the fact that the substantially cylindrically inclined surface 32S of region 32 and contoured surface 15-0 together form a sharp acute angle resulting in a very narrow crevice 31 which makes practical manufacture of the device extremely difficult and precludes the use of injection molding techniques.

Figure 4:
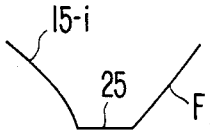
FIGS. 4 and 5 show respective portions of adjacent rings of the configurations of the prior art and the present invention.
Figure 5:
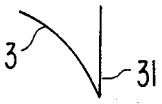
FIG. 5. PRIOR ART

This difference between the present invention and the prior art is perhaps best illustrated in FIGS. 4 and 5 which show the effect of the land portion 25 of the present invention and the narrow crevice 31 of the prior art. As shown in FIG. 4, the use of the land portion 25 provides structural strength to the respective rings while permitting each ring to be accurately geometrically defined relative to the face 7 of the lens. It turns out that the additional material presented by the land portion 25 does not substantially affect performance of the lens. However, the land material 25 provides a more gradually recessed surface to permit the lens to be practically manufactured.

Figure 6:
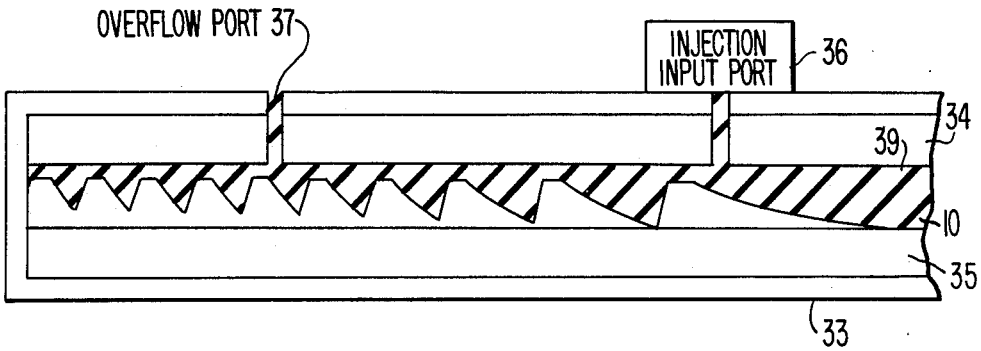
FIG. 6 is a diagrammatic illustration of an injection molding apparatus for manufacturing the lens of FIG. 2.

More specifically, with reference to FIG. 6, there is shown a portion of an injection molding apparatus and a portion of the lens of the present invention manufactured to have the configuration shown in FIG. 2, discussed above. The mold itself comprises an injection mold body 33 having an upper flat plate portion 34 through which the face 7 of the lens is to be defined and a lower mold form 35 which follows the successive surface contours 15-0-25-15-1-25-15-3 . . . 15-N of FIG. 2. A suitable dielectric material such as polypropylene doped with a dielectric constant control medium such as calcium carbonate is injected into a port 36 to fill the open area of the mold. Also shown in FIG. 6 is an overflow port 37 through which pressure of the injection and complete filing of the molding area is monitored. Because of the more gradually recessed contour provided by each land portion between adjacent rings of the lens, when the upper and lower plates of the mold are separated, the lens can be easily removed. This means that the lens of the present invention can be practically manufactured, as opposed to the complex machining process that is necessary in the device of the prior art. In the prior art configuration, however, because of the presence of regions 32 which form the acutely angled crevices 31, an injection molding process is practically unrealizable. The acute angle of the crevice 31 effectively prevents the molded material from being removed from the mold.

As pointed out previously, the surface contours of the central lobe and each successive ring of the dielectric lens of the present invention are precisely defined in terms of a trigonometric relationship between the focal point of the lens and equiphase lines to be obtained. This means that the lens is ideally suited for equiphase to focal point conversion for a particular frequency. For frequencies other than the frequency for which the lens was contoured, there is a shift in the focal point along the axis of the lens and a decrease in the signal-to-noise ratio. Fortunately, however, in the near vicinity of the focal point, the signal to noise ratio for shifts in frequency is still high enough for the lens to be used at frequencies other than the frequency for which the rings have been contoured. As a result, it is possible to use the lens in a compact multi- frequency transmit/-receiver mode by spatially separating the frequencies that are focussed by the lens.

Figure 7:
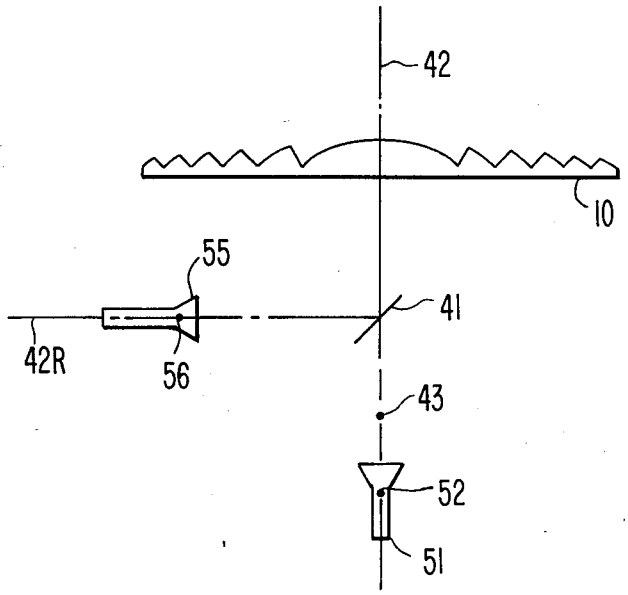
FIG. 7 is a diagrammatic illustration of a multi frequency transmit/receive apparatus employing the lens of FIG. 2.

More specifically, with attention directed to FIG. 7, there is shown a diagrammatic illustration of a multi frequency transmit/receive device using a single lens 10 in accordance with the present invention. In FIG. 7, lens 10 is shown as having a central axis 42. For the exact frequency for which the surface of the lens was contoured, there is some focal point 43 on axis 42. Located between focal point 43 and the face 7 of the lens 10 is dichroic filter 41. Dichroic filter 41 may be of the type described in an article entitled "A Quasi-Optical Polarization-Independent Diplex for Use in the Beam Feed System of Millimeter—Wave Antennas" by A. A. Saleh et al, I.E.E.E. Transactions on Antennas and Propagation, Vol. AP-24, No: 6, Nov. 1976. Shown beyond focal point 43 on axis 42 is a receive horn 51 which is designed to operate at some frequency $f_1$ separated from the design frequency $f_0$ of the lens 10 by some small margin. For example, for a design frequency $f_0$ of 13 GHz, microwave signals impinging on lens 10 at a frequency of $f_1 = 14$ GHz would be substantially focussed at point 52. In a similar fashion, spatially separated from horn 51 is a horn 55 having a focal point 56 for signals at a frequency $f_2$ lower than the design frequency $f_0$ of the lens, e.g. at a frequency $f_2$ on the order of 12 GHz. Through the spatial separation of these two frequencies by the action dichroic filter 41, which reflects signals at 12 GHz along an axis 42R but passes signals at 14 GHz along axis 42, the lens of the present invention is able to provide a compact arrangement for a transmit/receive unit having separate transmit and receive frequencies. Thus, for a complete system, the same lens may be used at opposite ends of the link, it being only necessary to locate the transmit and receive horns along the appropriate axis as defined by the action of dichroic filter 41.

As will be appreciated from the foregoing description, the lens configuration of the present invention not only offers an improved configuration for the contour shaping of the rings of the lens, thereby making the lens practically manufacturable, a feature which is not obtainable in the configuration of the prior art, and thereby a considerable savings in cost and weight, but provides an antenna element that permits a transmit/-receive satellite communications unit to be easily configured and readily constructed at a desired terminal site. By using a dichoic filter in combination with the compact dielectric lens arrangement of the present invention, ease of portability and rapid deployment of the satellite earth station communication equipment is afforded.

While I have shown and described several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

What is claimed:

1. A dielectric antenna lens comprising a body of dielectric material having a first surface at least a prescribed portion of which is normal to an axis of the lens and to at least one equiphase plane in which rays of a prescribed wavelength emanating from a focal point located on said axis are of equal phase, and a second surface defined by a series of contoured-surface rings concentric with said axis, the contoured surface of each ring being defined so that any ray at said wavelength emanating from said focal point and impinging upon said first surface so as to be refracted through said body of dielectric material exits said second surface and arrives at said equiphase plane at the same phase, and wherein each of said rings is connected by an annular land region having a prescribed thickness from said first surface, and wherein each of said rings has a first non-refracting surface portion extending from an annular land portion and delimited by the extent to which rays at said wavelength and emanating from said focal point are refracted through said each ring, and a second surface portion extending from said first surface portion and contoured therefrom to refract rays emanating from said focal point and refracting through said each of said rings to said equiphase plane, so as to be at the same phase thereat.

2. An electromagnetic wave transceiver apparatus for interfacing first and second planar wavefronts with respective first and second electromagnetic wave transducers comprising:

a dielectric antenna lens having a prescribed aperture for refracting an effectively planar wavefront incident on a first surface thereof through the body of material of which said lens is made and focussing said refracted wavefront to a prescribed focal point on an axis of said lens in accordance with the wavelength of said wavefront, such that said first planar wavefront is focussed at a first focal point on said axis and said second planar wavefront is focussed at a second focal point on said axis separated from said first focal point; and frequency selective spatial filter means, disposed between said lens and said first and second focal points, for causing said first wavefront that has been refracted through said lens and focussed thereby to be focussed at said first focal point on said axis, whereat said first transducer is disposed, and for causing said second wavefront that has been refracted through said lens and focussed thereby to be directed to a third focal point, spatially separated from said axis, whereat said second transducer is disposed.

3. An electromagnetic wave transceiver apparatus according to claim 2, wherein one of said transducers comprises an electromagnetic wave transmitting transducer and the other of said transducers comprises an electromagnetic wave receiving transducer.

4. An electromagnetic wave transceiver apparatus according to claim 2, wherein said dielectric antenna lens comprises a body of dielectric material having a first surface at least a prescribed portion of which is normal to an axis of the lens and to at least one equiphase plane in which rays of a prescribed wavelength emanating from a focal point located on said axis are of equal phase, and a second surface defined by a series of contoured-surface rings concentric with said axis, the contoured surface of each ring being defined so that any ray at said wavelength emanating from said focal point and impinging upon said first surface to be refracted through said body of dielectric material exits said second surface and arrives at said equiphase plane at the same phase, and wherein each of said rings is connected by an annular land region having a prescribed thickness from said first surface.

5. An electromagnetic wave transceiver apparatus according to claim 4, wherein each of said rings has a first non-refracting surface portion extending from an annular land portion and delimited by the extent to which rays at said wavelength and emanating from said focal point are refracted through said each ring, and a second surface portion extending from said first surface portion and contoured therefrom to refract rays emanating from said focal point and refracting through said each of said rings to said equiphase plane, so as to be at the same phase thereat.

6. An electromagnetic wave transceiver apparatus according to claim 4, wherein each of said rings has a first substantially conical surface portion extending from an annular land portion and upon which rays emanating from said focal point and refracting through said ring from said first surface do not intersect, so that said first surface portion does not effectively participate in the refraction of rays to said equiphase plane, and a second surface portion extending from said first surface portion to an annular ring, said second surface portion being contoured and dimensioned such that the entirety thereof participates in the refraction of rays emanating from said focal point and incident upon said first surface, so that said rays arrive at said equiphase plane in phase.

7. An electromagnetic wave transceiver apparatus according to claim 4, wherein said prescribed wavelength lies between the respective wavelengths of said first and second planar wavefronts.

8. An electromagnetic wave transceiver apparatus according to claim 2, wherein said dielectric antenna lens comprises a body of dielectric material having a first surface at least a prescribed portion of which is normal to an axis of the lens and to at least one equiphase plane in which rays of a prescribed wavelength emanating from a focal point located on said axis are of equal phase and a second surface defined by a series of contoured-surface rings concentric with said axis, the contoured surface of each ring being defined so that any ray at said wavelength emanating from said focal point and impinging upon said first surface so as to be refracted through said body of dielectric material exits said second surface and arrives at said equiphase plane at the same phase, and wherein each of said rings is connected by an annular land region having a prescribed thickness from said first surface and has a first substantially conical surface portion extending from an annular land portion and upon which rays emanating from said focal point and refracting through said ring from said first surface do not intersect, so that said first surface portion does not effectively participate in the refraction of rays to said equiphase plane, and a second surface portion extending from said first surface portion to an annular land portion of an adjacent ring, said second surface portion being contoured and dimensioned such that the entirety thereof participates in the refraction of rays emanating from said focal point and incident upon said first surface, so that said rays arrive at said equiphase plane in phase, and wherein said first substantially conical surface portion is inclined at a prescribed angle with respect to a respective annular land portion adjacent thereto so that rays emanating from a second surface portion of a ring adjacent to said respective annular land portion do not intersect said first substantially conical surface portion.

9. A dielectric antenna lens comprising a body of dielectric material having a first surface at least a prescribed portion of which is normal to an axis of the lens and to at least one equiphase plane in which rays of a prescribed wavelength emanating from a focal point located on said axis are of equal phase and a second surface defined by a series of contoured-surface rings concentric with said axis, the contoured surface of each ring being defined so that any ray at said wavelength emanating from said focal point and impinging upon said first surface so as to be refracted through said body of dielectric material exits said second surface and arrives at said equiphase plane at the same phase, and wherein each of said rings is connected by an annular land region having a prescribed thickness from said first surface and has a first substantially conical surface portion extending from said focal point and refracting through said ring from said first surface do not intersect, so that said first surface portion does not effectively participate in the refraction of rays to said equiphase plane, and a second surface portion extending from said first surface portion to an annular land portion of an adjacent ring, said second surface portion being contoured and dimensioned such that the entirety thereof participates in the refraction of rays emanating from said focal point and incident upon said first surface, so that said rays arrive at said equiphase plane in phase, and wherein said first substantially conical surface portion is inclined at a prescribed angle with respect to a respective annular land portion adjacent hereto so that rays emanating from a second surface portion of a ring adjacent to said respective annular land portion do not intersect said first substantially conical surface portion.

10. A method of forming a dielectric antenna lens comprising the steps of:

providing a mold through which said lens is to be produced, said mold being formed of a first mold portion having a first surface for defining a first surface of said lens, at least a prescribed portion of said first surface of said lens being normal to an axis of the lens and to at least one equiphase plane of which rays of a prescribed wavelength emanating from a focal point of said lens lying along said axis are of equal phase, and a second mold portion having a second surface for defining a second surface of said lens as a series of contoured-surface rings concentric with said axis, the contoured surface of each ring being defined so that any ray at said wavelength emanating from said focal point and impinging upon said first surface of said lens so as to be refracted through said lens exits said second surface of said lens and arrives at said equiphase plane at the same phase, and wherein each of said rings is connected to an adjacent ring by a land region therebetween such that the resulting lens has respective rings thereof connected by annular land regions therebetween, each annular land region of said lens having a prescribed thickness from the first surface thereof and having a first substantially conical surface portion extending from an annular land portion and upon which rays emanating from said focal point and refracting through said ring from said first surface of said lens do not intersect, so that said first substantially conical surface portion of said lens does not effectively participate in the refraction of rays to said equiphase plane, and a second surface portion extending from said first substantially conical surface portion of said lens to an annular land portion of an adjacent ring, said second surface portion being contoured and dimensioned such that the entirety thereof participates in the refraction of rays emanating from said focal point and incident upon said first surface of said lens, so that said rays arrive at said equiphase plane in phase, and wherein said first substantially conical surface portion is inclined at a prescribed angle with respect to a respective annular land portion adjacent thereto so that rays emanating from a second surface portion of a ring adjacent to said respective annular land portion do not intersect said first substantially conical surface portion;

injecting dielectric material of which said lens is to be formed between said first and second mold portions so as to injection mold said lens having its first surface on one side thereof and its second surface defined by said series of contoured rings and land regions therebetween on the opposite side thereof;

curing said dielectric material in said mold; and separating said first and second mold portions from said cured dielectric material, said land portion between rings assisting in the separation of said second mold portion from said cured dielectric material of said ones.

* * * * *